US007942359B2

(12) United States Patent
Kiriyama et al.

(10) Patent No.: US 7,942,359 B2
(45) Date of Patent: May 17, 2011

(54) CARBON FIBER PACKAGE AND PROCESS FOR PRODUCING THE SAME

(75) Inventors: Takayuki Kiriyama, Aichi (JP); Norihito Maki, Aichi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 98 days.

(21) Appl. No.: 12/440,028

(22) PCT Filed: Aug. 31, 2007

(86) PCT No.: PCT/JP2007/067044

§ 371 (c)(1),
(2), (4) Date: Mar. 5, 2009

(87) PCT Pub. No.: WO2008/029740

PCT Pub. Date: Mar. 13, 2008

(65) Prior Publication Data

US 2009/0314870 A1 Dec. 24, 2009

(30) Foreign Application Priority Data

Sep. 6, 2006 (JP) ..... 2006-242085
Jul. 31, 2007 (JP) ..... 2007-198419

(51) Int. Cl.
*B65H 55/04* (2006.01)
*B65H 54/38* (2006.01)

(52) U.S. Cl. ..... 242/178; 242/477.4

(58) Field of Classification Search ..... 242/174, 242/175, 176, 177, 178, 471, 477.4–477.8
See application file for complete search history.

(56) References Cited

U.S. PATENT DOCUMENTS

| | | | | |
|---|---|---|---|---|
| 4,779,813 | A | 10/1988 | Sugioka et al. | |
| 5,056,724 | A * | 10/1991 | Prodi et al. | 242/477.6 |
| 6,027,060 | A * | 2/2000 | Siepmann | 242/447.1 |
| 7,762,491 | B2 * | 7/2010 | Schmalholz | 242/477.6 |

FOREIGN PATENT DOCUMENTS

| | | |
|---|---|---|
| EP | 0 893 386 A1 | 1/1999 |
| JP | 7 25479 | 3/1995 |
| JP | 10 316311 | 12/1998 |

OTHER PUBLICATIONS

Machine translation of JP10-316311 A.*
Machine translation of JP07-025479 B2.*
European Search Report issued on Dec. 9, 2010, in European Patent Application No. 07806517.4 (4 pages).

* cited by examiner

*Primary Examiner* — William E Dondero
(74) *Attorney, Agent, or Firm* — Oblon, Spivak, McClelland, Maier & Neustadt, L.L.P.

(57) ABSTRACT

It is an object of the present invention to provide a package in an optimal form obtained by winding a carbon fiber bundle having a fineness of 25,000 to 35,000 deniers, which has a high wound density and is less apt to become loose, and a method for producing the same. The present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 13 to 14°, the traverse angle in the end of winding is 3° or larger, and the fractional portion W0 of the winding ratio W is in the range of 0.07 to 0.08.

12 Claims, 1 Drawing Sheet

CARBON FIBER PACKAGE AND PROCESS FOR PRODUCING THE SAME

TECHNICAL FIELD

The present invention relates to a carbon fiber package accurately formed to have a high wound density and being less apt to become loose, and to a method for producing the same.

BACKGROUND ART

Demands for carbon fibers in general industrial uses related to construction, civil engineering and energy are increasing year by year. In order to obtain the required fineness of carbon fibers in methods for forming a large structural material, for example, weaving and filament winding methods, at present, a certain number of carbon fiber bundles with about 7,000 to 20,000 deniers are lined up to perform forming. However, in forming by lining up, there is a problem wherein gaps are opened between lining up units to produce an irregular impregnation of the resin.

Furthermore, if carbon fiber bundles with about 7,000 to 20,000 deniers are used, especially, when a large and thick formed body is produced, the laminating number and the winding number must be increased, and it is disadvantageous in the aspect of forming time. Specifically, if the package of carbon fibers having a large number of filaments and a large thickness is available, there is advantage wherein the laminating number and the decrease of the winding number of carbon fibers to a high-dimensional processing facility, the shortening of forming time, and making the creel facility compact are feasible.

Patent Document 1 proposes a carbon fiber package of a square-end type obtained by winding carbon fibers having a fineness of 25,000 deniers or higher on a bobbin, wherein the width per unit fineness of the carbon fibers is in the range of $0.15\times10^{-3}$ to $0.35\times10^{-3}$ mm/denier, the traverse angle in the beginning and the end of winding are in the range of 10 to 30° and 3 to 15°, respectively, and the fractional portion W0 of the winding ratio W is in the range of 0.12 to 0.88.

Patent Document 1: Japanese Patent Application Laid-Open No. 10-316311

DISCLOSURE OF THE INVENTION

Problems to be Solved by the Invention

However, since the fractional portion W0 of the winding ratio W was in the range of 0.12 to 0.88 in the carbon fiber package according to Patent Document 1, for example, when the fractional portion W0 was 0.5, there was a problem wherein the location of the wound carbon fibers completely overlapped the location of the carbon fibers wound two traverses before, and the carbon fiber package could not be accurately formed in the shape that was less apt to become loose at a high wound density.

It is an object of the present invention to provide a package in an optimal form obtained by winding a carbon fiber bundle having a fineness of 25,000 to 35,000 deniers, which has a high wound density and is less apt to become loose, and a method for producing the same.

Means for Solving the Problems

Specifically, the first gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 13 to 14°, the traverse angle in the end of winding is 3° or larger, and the fractional portion W0 of the winding ratio W is in the range of 0.07 to 0.08.

The second gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 13 to 14°, the traverse angle in the end of winding is 30 or larger, and the fractional portion W0 of the winding ratio W is in the range of 0.90 to 0.91.

The third gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 10 to 11°, the traverse angle in the end of winding is 2° or larger, and the fractional portion W0 of the winding ratio W is in the range of 0.07 to 0.08.

The fourth gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 13 to 14°, the traverse angle in the end of winding is 5° or larger, and the fractional portion W0 of the winding ratio W is in the range of 0.09 to 0.10.

The fifth gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 13 to 14°, the traverse angle in the end of winding is 3° or larger, and the fractional portion W0 of the winding ratio W is in the range of 0.92 to 0.93.

The sixth gist of the present invention is a carbon fiber package obtained by winding a carbon fiber bundle having a fineness of 25,000 to 35,000 deniers on a bobbin in a square-end type, wherein the width per unit fineness of the carbon fiber bundle is in the range of $0.30\times10^{-3}$ to $0.63\times10^{-3}$ mm/denier, the traverse angle in the beginning of winding is in the range of 10 to 11°, the traverse angle in the end of winding is 2° or larger, and the fractional portion W0 of the winding ratio W is in the range of 0.92 to 0.93.

The seventh gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 13 to 14°, the traverse angle in the end of winding is made to be 3° or larger, and the fractional portion W0 of the winding ratio W is in the range of 0.07 to 0.08.

The eighth gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 13 to 14°, the traverse angle in the end of winding is made to be 3° or larger, and the fractional portion W0 of the winding ratio W is in the range of 0.90 to 0.91.

The ninth gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 10 to 11°, the traverse angle in the end of winding is made to be 2° or larger, and the fractional portion W0 of the winding ratio W is in the range of 0.07 to 0.08.

The tenth gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 13 to 14°, the traverse angle in the end of winding is made to be 5° or larger, and the fractional portion W0 of the winding ratio W is in the range of 0.09 to 0.10.

The eleventh gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 13 to 14°, the traverse angle in the end of winding is made to be 3° or larger, and the fractional portion W0 of the winding ratio W is in the range of 0.92 to 0.93.

The twelfth gist of the present invention is a method for producing a carbon fiber package, comprising: winding a carbon fiber bundle having a fineness of 25,000 to 35,000 deniers on a bobbin in a square-end type, wherein the width per unit fineness of the carbon fiber bundle is made to be in the range of $0.30\times10^{-3}$ to $0.63\times10^{-3}$ mm/denier, the traverse angle in the beginning of winding is made to be in the range of 10 to 11°, the traverse angle in the end of winding is made to be 2° or larger, and the fractional portion W0 of the winding ratio W is in the range of 0.92 to 0.93.

EFFECT OF THE INVENTION

According to the carbon fiber package of the present invention and the method for producing the same, the carbon fiber bundle having a fineness of 25,000 to 35,000 deniers can be made to be a package having a high wound density and good wound shape that is less apt to become loose and has good unwind property.

DESCRIPTION OF SYMBOLS

Figure 1:
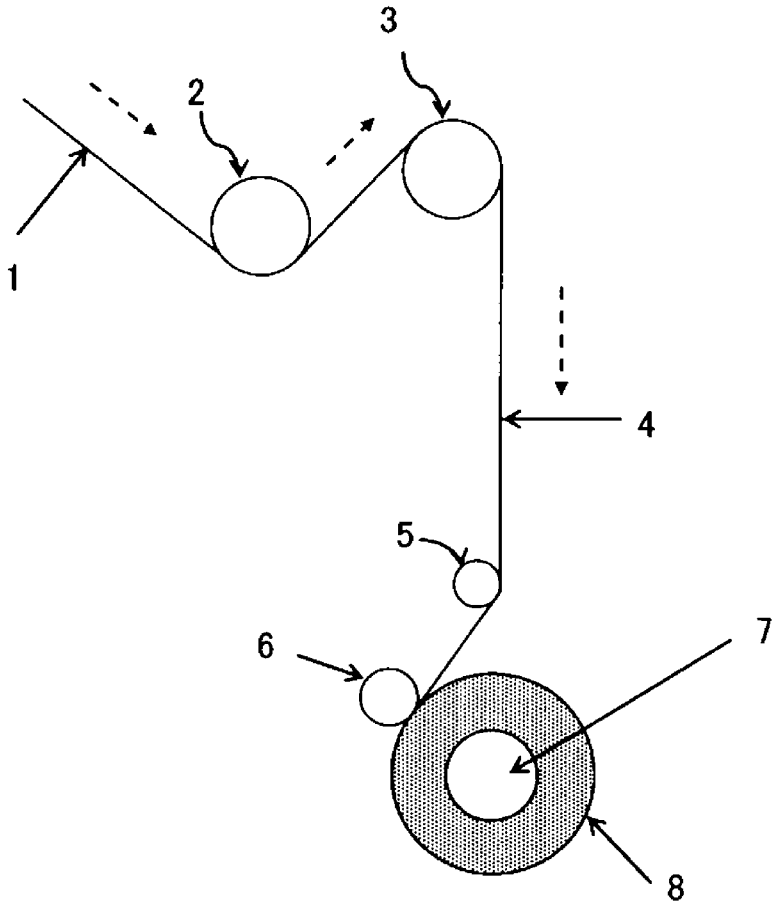
FIG. 1 is a schematic diagram of a winder part of a winding machine used in Examples of the present invention.

1 carbon fiber bundle
2, 3 and 5 guiding members
4 location of tensile-strength measurement
6 pressure roll
7 bobbin
8 carbon fiber bundle package

BEST MODE FOR CARRYING OUT THE INVENTION

Hereafter, the present invention will be described in detail. In the present invention, the fineness of the carbon fiber bundle is represented by the fineness of a single yarn (denier)×the number of filaments. The fineness of the carbon fiber bundle can be in the range of 25,000 to 35,000 deniers. Since the fineness of a single yarn is normally 0.2 to 0.9 denier, the number of filaments may be about 28,000 to 175,000.

There are some methods for making the fineness of a wound carbon fiber bundle to be 25,000 to 35,000 deniers, such as: a method wherein a precursor fiber with a large denier value is used as a starting material; a method wherein a certain number of precursor fibers with a small filament value are combined in the middle of the calcining process and before completely winding by the winder; and a method wherein what have been once wound as carbon fibers are drawn out of the creel, and are wound again while combining them; but the method is not specifically limited to any of these methods.

In the present invention, the width per unit fineness of the carbon fiber bundle is controlled to be $0.30\times10^{-3}$ to $0.63\times10^{-3}$ mm/denier. The control method is not specifically limited, but a method, such as a method wherein a carbon fiber bundle is contacted to a roller having grooves, a fixed guide and the like so as to have a prescribed width; and a method wherein the movement of the single yarn is restrained by adding a sizing agent to prevent the width from varying, can be carried out alone or in combination to achieve the intended width per unit fineness of the carbon fiber bundle.

In producing a carbon fiber package, by satisfying the following conditions, a carbon fiber package having a high wound density and good wound shape that is less apt to become loose, and has good unwind property can be obtained.

(1) When the Traverse Angle in the Beginning of Winding is in the Range of 13 to 14°

The traverse angle in the end of winding is made to be 3° or larger, and the later described fractional portion W0 of the winding ratio is made to be in the range of 0.07 to 0.08, 0.90 to 0.91, or 0.92 to 0.93. Alternatively, the traverse angle in the end of winding is made to be 5° or larger, and the later described the fractional portion W0 of the winding ratio is made to be in the range of 0.09 to 0.10.

(2) When the Traverse Angle in the Beginning of Winding is in the Range of 10 to 11°

The traverse angle in the end of winding is made to be 2° or larger, and the later described fractional portion W0 of the winding ratio is made to be in the range of 0.07 to 0.08, or 0.92 to 0.93.

Figure 2:
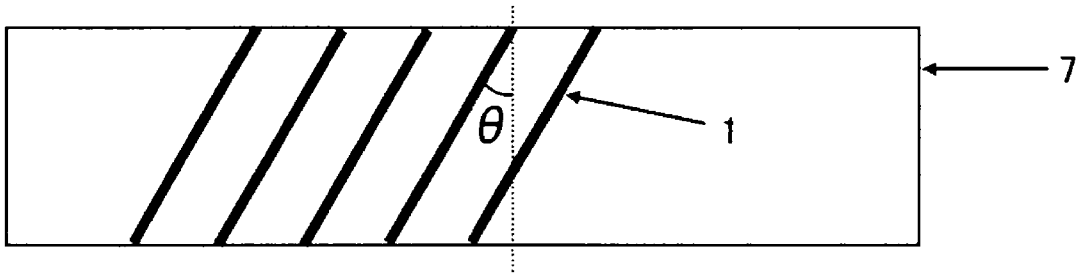
FIG. 2 is a diagram illustrating the traverse angle.

The traverse angle used herein is defined as an angle between the carbon fiber bundle 1 and the bobbin 7, and is represented as angle θ in FIG. 2.

When a carbon fiber bundle is wound in a winding ratio prescribed by the present invention using a winder, if the traverse angle in the beginning of winding and the winding ratio are once determined, the traverse angle in the end of winding can be determined by the wound quantity of the carbon fiber bundle. Specifically, the traverse angle is gradually decreased as the carbon fiber bundle is wound, and as the wound quantity is larger, the traverse angle in the end of winding becomes smaller. If the traverse angle in the end of winding is larger than the value prescribed by the present invention, a carbon fiber package having a high wound density and good wound shape that is less apt to become loose and has good unwind property can be obtained. Specifically, if the winding of the carbon fiber bundle is started in the prescribed winding ratio and the traverse angle in the beginning of winding specified by the present invention, and if the wound quantity of the carbon fiber bundle is made to be equal to or lower than the quantity determined by the lower limit value of the traverse angle, a carbon fiber package having a good wound shape that is less apt to become loose can be obtained.

It is preferable that the carbon fiber bundle to be wound is evenly dispersed and distributed on the bobbin. The even dispersion of the position of yarns on the bobbin is determined by the ratio of the revolution speed of the bobbin to the traverse speed, i.e. the winding ratio. Specifically, the winding ratio W is represented by the following equation:

$$W=2L/(\pi D0 \tan \theta)$$

wherein L is the stroke of the guide of winder traversing in substantially parallel to the bobbin, i.e. the traverse width (mm), D0 is the outer diameter of the bobbin (mm), and θ is the traverse angle in the beginning of winding.

When the winding ratio is an integer, the position of the yarn wound after one traverse entirely overlaps with the yarn wound in the preceding traverse. If the winding ratio deviates from an integer, the position of the yarn wound after one traverse deviates from the position of the yarn wound in the preceding traverse according to the deviation. When the winding ratio is an integer, since the yarn is continuously wound on the entirely same position, the yarn is localized, and forms a package having an uneven low wound density apt to become loose.

When the fractional portion W0 (difference between the winding ratio and the integer portion of the winding ratio) is a multiple of 1/n (n: an integer of 2 or more and 10 or less), the position of the yarn wound after n-traverses entirely overlaps the position where the yarn before n-traverses is wound. Specifically, in the same manner as in the case wherein the winding ratio is an integer, the yarn is continuously wound on the entirely same position. Therefore, when the number of n is small, the yarn is particularly localized, and forms a package having an uneven low wound density apt to become loose.

In order to make the yarn to be wound evenly distribute on the bobbin, the fractional portion of the deviation from the integer, specifically, the fractional portion W0 of the winding ratio W is in the ranges of 0.07 to 0.08, 0.09 to 0.10, 0.90 to 0.91, or 0.92 to 0.93, and the traverse angles of the beginning of winding and the end of the winding are made to be in the above-described range. In this range, since the position where the yarn is present can be evenly changed per traverse, a package having a high wound density can be formed.

EXAMPLES

The present invention will be more specifically described below referring to examples.

Example 1

Using a winding machine of the configuration shown in FIG. 1, a carbon fiber bundle having a total fineness of 29,700 deniers (the number of filaments: 50,000) was wound on a paper bobbin with an inner diameter of 82 mm and with a length of 280 mm while maintaining a width of 12 mm to produce a carbon fiber package of a square-end type with a wound width of 254 mm. The conditions for winding and the properties of the obtained carbon fiber package are shown in Table 1. Specifically, carbon fiber bundle 1 was transferred by guide members 2, 3 and 5 in the direction shown by broken-line arrows in FIG. 1 to introduce it between pressure roll 6 and bobbin 7, and was wound on bobbin 7 to obtain carbon fiber package 8.

The contact pressure during winding is indicated as an average obtained from the values of the force measured three times when bobbin 7 contacts pressure roll 6 using a hand scale. The tension during winding is indicated as an average obtained from the maximum and minimum values of the force against the carbon fiber bundle at tension measured by a tension meter at the location of tensile-strength measurement 4 before the carbon fiber bundle is wound on bobbin 7.

Examples 2 to 6

Carbon fiber package of a square-end type were produced in the same manner as in Example 1 except that the conditions for winding were made to be values shown in Table 1. The properties of the obtained carbon fiber packages were shown in Table 1.

Examples 7 and 8

Carbon fiber packages of a square-end type were produced in the same manner as in Example 1 except that the total fineness of the carbon fiber bundle was 28,500 deniers (the number of filaments: 48,000), and the conditions for winding were made to be values shown in Table 1. The properties of the obtained carbon fiber packages were shown in Table 1.

Comparative Examples 1 to 3

Although the winding of the carbon fiber bundle on the bobbin was started under the conditions in the same manner as the conditions of Example 1 except that the traverse angles in the beginning of winding and the winding ratios were made to be values shown in Table 2, the carbon fiber bundle was localized on the bobbin, and the carbon fiber package could not be obtained.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Fineness (denier) | 29700 | 29700 | 29700 | 29700 | 29700 | 29700 | 28500 | 28500 |
| Yarn width (mm) | 12 | 12 | 12 | 12 | 12 | 12 | 12 | 12 |
| Traverse angle (°) in the beginning of winding | 13.7 | 13.7 | 14 | 14 | 10.1 | 10.1 | 13.7 | 13.7 |
| Traverse angle (°) in the end of winding | 3.82 | 5.27 | 3.9 | 5.64 | 2.79 | 3.91 | 5.65 | 6.88 |
| Winding ratio | 8.0769 | 8.0769 | 7.9091 | 7.9091 | 11.0706 | 11.0706 | 8.0938 | 8.0938 |
| Traverse width (mm) | 254 | 254 | 254 | 254 | 254 | 254 | 254 | 254 |

TABLE 1-continued

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Outside diameter of the bobbin (mm) | 82 | 82 | 82 | 82 | 82 | 82 | 82 | 82 |
| Tension (N) at the beginning of winding | 15 | 15 | 15 | 15 | 15 | 15 | 15 | 15 |
| Tension (N) at the end of winding | 9 | 10 | 9 | 10 | 9 | 10 | 12 | 13 |
| Contact pressure (N) at the beginning of winding | 20 | 20 | 20 | 20 | 20 | 20 | 4 | 4 |
| Contact pressure (N) at the end of winding | 12 | 16 | 12 | 16 | 12 | 16 | 13 | 11 |
| Wound diameter (mm) | 295 | 217 | 280 | 207 | 290 | 214 | 202 | 166 |
| Wound density | 1.03 | 1.03 | 1.15 | 1.15 | 1.06 | 1.06 | 1.08 | 1.08 |
| Wound shape | Good | Good | Good | Good | Good | Good | Good | Good |
| Unwind property | Good | Good | Good | Good | Good | Good | Good | Good |
| Weight (kg) | 16.5 | 8.25 | 16.5 | 8.25 | 16.5 | 8.25 | 7.5 | 4.5 |

TABLE 2

| | Co. Ex. 1 | Co. Ex. 2 | Co. Ex. 3 |
|---|---|---|---|
| Traverse angle (°) in the beginning of winding | 12.3 | 9.4 | 11.2 |
| Winding ratio | 9.0443 | 11.9116 | 9.9522 |

As seen from the results of Examples 1 to 8 and comparative Examples 1 to 3, by satisfying the requirements prescribed in the present invention, even using a carbon fiber bundle having a high fineness, a package having a high wound density and good wound shape that is less apt to become loose, and has good unwind property can be obtained.

What is claimed is:

1. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 13 to 14°, a traverse angle in the end of winding is 3° or larger, and a fractional portion W0 of a winding ratio W is in the range of 0.07 to 0.08.

2. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 13 to 14°, a traverse angle in the end of winding is 3° or larger, and a fractional portion W0 of a winding ratio W is in the range of 0.90 to 0.91.

3. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 10 to 11°, a traverse angle in the end of winding is 2° or larger, and a fractional portion W0 of a winding ratio W is in the range of 0.07 to 0.08.

4. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 13 to 14°, a traverse angle in the end of winding is 5° or larger, and a fractional portion W0 of a winding ratio W is in the range of 0.09 to 0.10.

5. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 13 to 14°, a traverse angle in the end of winding is 3° or larger, and a fractional portion W0 of a winding ratio W is in the range of 0.92 to 0.93.

6. A carbon fiber package obtained by winding a carbon fiber bundle having a fineness of 25,000 to 35,000 deniers on a square-end bobbin, wherein a width per unit fineness of the carbon fiber bundle is in the range of $0.30\times10^{-3}$ to $0.63\times10^{-3}$ mm/denier, a traverse angle in the beginning of winding is in the range of 10 to 11°, a traverse angle in the end of winding is 2° or larger, and a fractional portion W0 of a winding ratio W is in the range of 0.92 to 0.93.

7. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 13 to 14°, a traverse angle in the end of winding is made to be 3° or larger, and a fractional portion W0 of a winding ratio W is in the range of 0.07 to 0.08.

8. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 13 to 14°, a traverse angle in the end of winding is made to be 3° or larger, and a fractional portion W0 of a winding ratio W is in the range of 0.90 to 0.91.

9. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 10 to 11°, a traverse angle in the end of winding is made to be 2° or larger, and a fractional portion W0 of a winding ratio W is in the range of 0.07 to 0.08.

10. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 13 to 14°, a traverse angle in the end of winding is made to be 5° or larger, and a fractional portion W0 of a winding ratio W is in the range of 0.09 to 0.10.

11. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 13 to 14°, a traverse angle in the end of winding is made to be 3° or larger, and a fractional portion W0 of a winding ratio W is in the range of 0.92 to 0.93.

12. A method for producing a carbon fiber package, comprising: winding a carbon fiber bundle having a fineness of 25,000 to 35,000 deniers on a square-end bobbin, wherein a width per unit fineness of the carbon fiber bundle is made to be in the range of $0.30\times10^{-3}$ to $0.63\times10^{-3}$ mm/denier, a traverse angle in the beginning of winding is made to be in the range of 10 to 11°, a traverse angle in the end of winding is made to be 2° or larger, and a fractional portion W0 of a winding ratio W is in the range of 0.92 to 0.93.

* * * * *